US008359771B2

(12) United States Patent
Holzer et al.

(10) Patent No.: US 8,359,771 B2
(45) Date of Patent: Jan. 29, 2013

(54) SPORTS SHOE, IN PARTICULAR SKI SHOE AND TIGHTENING MEANS THEREFOR

(75) Inventors: Helmut Holzer, St. Johann (AT); Gerhard Trinkaus, Koeflach (AT); Jason Roe, Wagrain (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 12/928,467

(22) Filed: Dec. 13, 2010

(65) Prior Publication Data

US 2011/0083343 A1 Apr. 14, 2011

Related U.S. Application Data

(62) Division of application No. 11/711,375, filed on Feb. 27, 2007, now abandoned.

(30) Foreign Application Priority Data

Feb. 28, 2006 (AT) ..... A 334/2006

(51) Int. Cl.
*A43B 5/04* (2006.01)
*A43C 11/00* (2006.01)

(52) U.S. Cl. ..... 36/50.5; 36/115; 36/117.1

(58) Field of Classification Search ..... 36/117.1, 36/117.2, 115, 50.5, 51, 50.1
See application file for complete search history.

(56) References Cited

U.S. PATENT DOCUMENTS

| | | | | |
|---|---|---|---|---|
| 3,561,139 | A | | 2/1971 | Stillman |
| 4,282,659 | A | | 8/1981 | Bourque et al. |
| 4,624,063 | A | | 11/1986 | Delery |
| 5,007,186 | A | * | 4/1991 | Bischof et al. ..... 36/118.9 |
| 5,152,084 | A | | 10/1992 | Bonnaventure |
| 5,365,675 | A | * | 11/1994 | Shabram, Jr. ..... 34/109 |
| 5,381,611 | A | | 1/1995 | Tonel et al. |
| D357,795 | S | * | 5/1995 | Crowley ..... D2/972 |
| 5,410,822 | A | * | 5/1995 | Vaccari ..... 36/118.2 |
| 5,590,481 | A | | 1/1997 | Vaccari |
| 5,718,067 | A | | 2/1998 | Ostinet et al. |
| 5,787,611 | A | | 8/1998 | Bonaventure |
| 5,806,212 | A | | 9/1998 | Benoit et al. |
| 6,016,614 | A | | 1/2000 | Best |
| 6,026,594 | A | | 2/2000 | Fougere |

FOREIGN PATENT DOCUMENTS

| | | |
|---|---|---|
| FR | 2 876 883 | 4/2006 |
| WO | WO 99/65348 | 12/1999 |

* cited by examiner

*Primary Examiner* — Jila M Mohandesi
(74) *Attorney, Agent, or Firm* — Collard & Roe, P.C.

(57) ABSTRACT

The invention relates to a sports shoe (1) with an outer shell (2) made of injection moulded plastic, in particular a ski shoe with at least one tightening means (12) arranged in the upper end section of the shoe collar (5) running ring-like around the upper end section of the shoe collar (5), and with at least one adjusting means (13) for tightening or limiting the width of the entry opening into the sports shoe (1) as necessary. For this a first and a further tightening element (15, 16) are arranged above one another in vertical direction within a section of the length of the tightening means (12), where the tightening elements (15, 16) run essentially parallel to one another. The first tightening element (15) is designed to bear against the peripheral sections of the comparatively flexible inner shoe (3) or its tongue (17) and the further tightening element (16) is designed to bear against the upper end section of the shoe collar (5) made of a relatively rigid plastic. In this way pressure points can be avoided or reduced on the leg of the user and the level of comfort when using the sports shoe (1) can be increased.

26 Claims, 5 Drawing Sheets

SPORTS SHOE, IN PARTICULAR SKI SHOE AND TIGHTENING MEANS THEREFOR

CROSS REFERENCE TO RELATED APPLICATIONS

This application is a divisional of and Applicants claim priority under 35 U.S.C. §§120 and 121 of U.S. application Ser. No. 11/711,375 filed on Feb. 27, 2007, now abandoned, which claims priority under 35 U.S.C. §119 of Austrian Patent Application No. A 334/2006 filed Feb. 28, 2006, the disclosures of each of which are hereby incorporated by reference.

BACKGROUND OF THE INVENTION

1. Field of the Invention

The invention relates to a sports shoe, comprising an outer shell made from a relatively rigid plastic, an inner shoe mounted at least partly therein, which is comparatively flexible, and an annular tightening means for the shoe collar.

2. Prior Art

A generic sports shoe, in particular a ski shoe with an annular tightening means for the shoe collar is known for example from U.S. Pat. No. 6,026,594 A. Said tightening means for limiting the width or tightening the upper end section of the shoe collar consists in this case of several, in particular three strap elements arranged in a row and connected or connectable at their ends in a chain-like manner. The central or middle strap element of the tightening means which is closed in a ring-like manner in the position of use is designed to be elastically extensible. The strap elements connected to the end sections of the elastic strap element can be connected together securely at their ends facing away from the elastic strap element by means of a fastener-like adjusting means, whereby the effective length of the tightening means can be adjusted individually. In the position of use in which the tightening means is active, due to the elastic strap section a relatively constant pressure is exerted directly onto the shoe collar and indirectly onto the section of the inner shoe surrounding the lower leg of the user. This means that an activated tightening means with the interconnection of the outer, hard shoe collar exerts a specific preloading force on the inner shoe and thus consequently on the lower leg of the user. This elastic strap section is designed to prevent any loosening of the shoe collar and the formation of spaces between the lower leg and the shoe collar even after a long period of use during which many loading and unloading movements occur. In particular, by means of this design the pressure between the leg of the user and shoe can be kept constant even over a long period. By means of this known design of tightening means with an elastic strap section any unwanted loosening of the shoe collar can be counteracted during the progressive use of the sports shoe, but the wearing comfort of the ski shoe is not improved in this way.

From U.S. Pat. No. 5,718,067 A a generic sports shoe with a tightening means for the upper neck section is also known. This strap-like tightening means extends from the rear section of the relatively rigid collar of the sports shoe in a ring shape up to the front collar section of the sports shoe, and in the actively tightened state supports the front side of the tongue of the comfort inner shoe inserted into the sports shoe, so as to prevent the widening of the inner shoe in the tongue section. However, this known design is not wholly satisfactory For sports shoes with a relatively flexible elastic inner shoe and an outer shell body that is comparatively rigid and surrounds the inner shoe at least partly, it is particularly important for the inner shoe to provide the user of the sports shoe with a high degree of comfort. The main purpose of the outer shell body is to transfer force to a sports device effectively, as in the case e.g. of ski shoes, roller or ice skates, snowboards and the like. In order to prevent unpleasant pressure points on the foot of the user, the known inner shoes are provided with thick padding and the inner shoes are tailored as precisely as possible to the shape of the foot of the respective user by using foaming procedures. These measures only produce partly satisfactory results however, and the individual foaming or fitting procedures are labour intensive, in particular time consuming and expensive. Furthermore, inner shoes are known which have board-like reinforcing elements stitched or adhered onto the outside. In addition, in known inner shoes partial recesses or depressions are provided for specific parts of the foot, e.g. for the knuckles, in order to prevent unpleasant pressure points on the foot of the respective user. With respect to the structure of the inner shoe these measures increase the production costs of the sports shoe and such preventative measures cannot be adjusted to individual needs or the diverse foot shapes of different users. Moreover, these types of inner shoe cannot be altered afterwards.

SUMMARY OF THE INVENTION

The underlying objective of the invention is to create a sports shoe comprising a flexible elastic inner shoe and comparatively hard outer shell, which provides an increased level of comfort with respect to wear and use, and because the level of comfort is greater over a long period local pressure points on the leg, in particular on the shin of the user, can be prevented.

This objective of the invention is achieved by means of a sports shoe with improved tightening means according to the invention. A particular advantage is that the first or upper tightening element acts with a specific preloading on the section of the inner shoe projecting over the shoe collar, and the further tightening element can exert a defined amount of force on the upper end section of the shoe collar. In particular, a one piece, multiple-strand tightening means is created which, taking into account its position of use, with its upper tightening element acts on the inner shoe in particular on the front section of the inner shoe in the region of the tongue, whilst the lower section of the tightening means is allocated to the upper end section or the so-called neck of the shoe collar. In this way, advantageously the forces to be transferred between the foot of the user and the sports shoe, in particular those between the shin and the sports shoe, can be better distributed or more evenly distributed. In particular, in a surprisingly simple manner local pressure points on the foot of the user, in particular in the region of the transitional section between the upper edge of the shoe collar and the upper neck of the inner shoe, are avoided or considerably reduced. Mainly in this way a much more even transfer of pressure is obtained between the upper end section of the relatively hard or rigid shoe collar and the section of the inner shoe projecting over the shoe collar. In particular, by means of the at least partly double-stranded tightening means the structural transitional stage between the upper end of the collar and the inner shoe mounted therein is smoothed out to a certain extent. This means that by means of the improved tightening means a more even or harmonious direction of pressure or force is created in the transitional section between the collar neck and the inner shoe. Furthermore, by means of this design of the tightening means any undesirable slipping and any associated loosening of the tightening means is counteracted, as there is a precise allocation of the tightening elements on the one hand to the inner shoe and on the other hand to the shoe collar. By means of the at least partial splitting of the tightening strap in the region of the transitional stage between the collar neck and the inner shoe any unwanted slipping of the tightening means, in particular during the use of the sports shoe, in upwards direction or in downwards direction is reliably counteracted. This means that the position of the tightening strap selected by the user of the sports shoe is reliably maintained even after lengthier or intensive, changing pressure loads. A further advantage is that with respect to the pressures acting between the shoe collar or the inner shoe and the foot of a user there is relatively uniform and harmonious loading and path characteristic curve, which means that special measures are not necessarily required on the inner shoe or on the shoe collar. As a result, the tightening means described can be used successfully for a large number of sports shoes with a comparatively rigid outer shell and a relatively soft inserted inner shoe.

By means of the specifically allocated tightening elements according to an embodiment the tightening effect of the latter on the upper end section of the sports shoe can be made optimum use of and the respective requirements or the existing, structure of the sports shoe can be taken into account more effectively.

A further development is also advantageous, as thereby the tightening or pretensioning of the tightening elements can be adjusted as well as possible to the respective conditions or individual requirements. For example, this can be achieved in a simple manner by altering and defining the effective length of the first and/or further tightening element.

By means of the measures according to another embodiment, the tightening means exerts a corresponding amount of prestressing on the upper section of the shoe even after a long period of use, and the tightening means maintains the intended and correct position relative to the upper collar section of the sports shoe for a long period. In particular, even with the alternating loading and unloading of the upper collar section of the sports shoe any undesirable slipping or displacement of the tightening means is more or less prevented. This can be achieved by means of the elastic extensibility and/or the increased friction closure of the elastic tightening element relative to the upper collar section of the sports shoe.

In another embodiment, it is advantageous that the direction of pressure is as uniform as possible or is relatively harmonious in the transition zone between the upper limiting edge of the shoe collar and the upper edge section of the inner shoe. In particular, a relatively even transfer of pressure onto the lower leg of the user of the sports shoe can be achieved.

In the design according to another aspect it is advantageous that any twisting or torsion of the tightening means about its longitudinal axis is suppressed effectively even in the inactive position of the tightening means. Furthermore, a good distribution of pressure is achieved by means of the strap-like tightening elements.

By way of the measures according to another aspect a localized and effective allocation of the first and further tightening elements can be achieved. In particular, in this way the force effects of the tightening elements relative to the respective shoe sections can be separated clearly and sufficiently.

By way of the measures according to another aspect the tightening or tensioning force acting on the inner shoe or on its tongue can be introduced or transferred more effectively. In particular, linear pressure points between the upper tightening element and the inner shoe are prevented as far as possible.

By means of another design the desired or correct position of the tightening means relative to the sports shoe can be better maintained.

The measures according to another aspect result in a reliable positioning of the tightening means and at the same time an effective pressure loading of the respective shoe sections.

By way of the measures according to another aspect it is possible to stabilize the optimum or intended position of the tightening means and to achieve a pressure loading of the inner shoe or its tongue that covers as large an area as possible with the upper tightening element.

By way of the measures according to another aspect an increased pressure or minimum pressure or a minimum pretensioning is exerted on the comparatively rigid shoe collar, before the first or upper tightening element can act on the inner shoe or its tongue section. In this way it is ensured that by way of the tightening means a much greater preloading is exerted on the upper end section of the shoe collar than on the upper end section of the inner shoe, whereby the shoe collar is closed correctly or is tightened to fit by the user.

By way of the measures according to another aspect for a plurality of different models and sizes of sports shoes a good ratio is created between the build up of pressure on the shoe collar and the build up of pressure on the inner shoe or its tongue.

By way of the design according to another aspect it is possible to prevent the elastically extensible tightening element from being stretched beyond the limit of its elasticity. In particular, the overstretching of the elastic tightening element can be prevented in a simple manner.

By way of the measures according to another aspect the double or multiple strand part of the tightening means merges into a joint tightening strand. In this way a multiple arrangement of the adjusting means for pretensioning the tightening means is avoided and a simplified assembly or more economical attachment of the tightening means onto the sports shoe is made possible.

By way of the measures according to another aspect only one anchoring or retaining means is formed on the shoe collar in order to mount or secure the double or multiple strand tightening means onto the sports shoe. By way of the central force introduction and assembly point however the production costs are also kept low and a rapid adjustment of the tightening means is made possible.

By means of the design according to another aspect the effective length of the tightening means can be varied in a simple manner and a more economical structure can be created. Furthermore, with only one embodiment of the tightening means a plurality of collar widths or shoe sizes can be accounted for.

By means of the design according to another aspect the structural volume or the largest diameter of the shoe collar is not enlarged significantly, so that articles of clothing, in particular trouser bottoms can be pulled easily over the edge of the collar of the sports shoe.

By way of the measures according to another aspect a stable connection withstanding high tensile forces can be created between the tightening elements and the coupling element. Furthermore, in this way the structural volume or the thickness of the tightening means can be kept as low as possible in the transitional section between the tightening elements.

By way of the measures according to another aspect it is made easier to avoid or reduce pressure points in the relatively sensitive upper neck section of the inner shoe. In particular, due to the comparatively broad design of the upper tightening element there is a better distribution of its pressure forces onto the inner shoe or its tongue.

By way of the measures according to another aspect a robust, particularly strong tightening means is created which is still comfortable to handle through its covering or casing. Furthermore, the virtually integrated or covered tightening elements have an appropriate visual appearance. By means of the plastic elements contained therein a predefined, for example curved shape can be created for the multiple or double strand section of the tightening means, and thus a good fit can be obtained against the contour of the shoe collar.

By means of the advantageous development according to another aspect transitional stages between the upper and lower tightening element, particularly in the active position of the tightening means, are weakened or reduced. In addition pressure acting on only one of the two tightening elements is also transferred partly onto the further tightening element, so that there is a certain equalisation of the forces acting on the tightening elements.

By way of the measures according to another aspect the inner shoe can be extended or widened elastically by the forces occurring during use, whereas for the shoe collar the tolerances for extension and widening are much lower.

By way of the measures according to another aspect a high tightening or tensioning effect of the tightening means can be obtained even when the user applies a relatively small activating force.

By means of the designs according to another aspect the collar section of the sports shoe exerts as far as possible a balanced tightening effect on the lower leg, in particular on the calf and the shin of the user.

Independently of this, the objective of the invention is also achieved by means of improved tightening means according to the invention.

BRIEF DESCRIPTION OF THE DRAWINGS

The invention is explained in more detail in the following with reference to the embodiments shown in the drawings.

DETAILED DESCRIPTION OF PREFERRED EMBODIMENTS

First of all it should be noted that in the various embodiments described the same parts are denoted by the same reference numbers and the same component names, whereby disclosures contained throughout the description can be applied to the same parts with the same reference numbers or component names. In addition, details on position used in the description, such as e.g. top, bottom, side etc., refer to the Figure being described and illustrated at the time, and if there is a change in position should be transposed to the new position. Furthermore, individual features or combinations of features from the various embodiments shown and described can represent in themselves independent solutions according to the invention.

Figure 1:
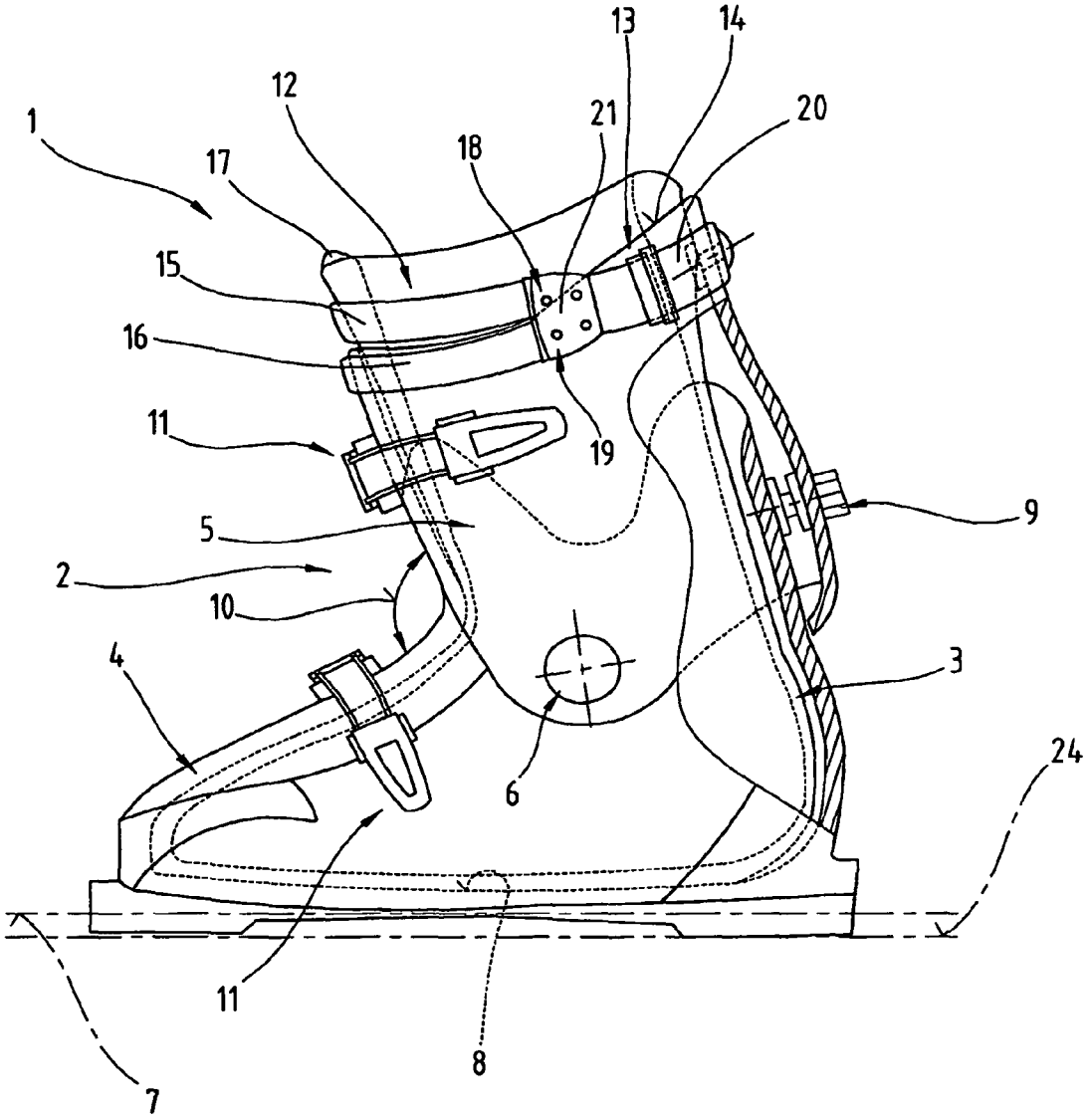
FIG. 1 shows a generic sports shoe in side view and partial cross section in connection with a tightening means that is essential to the invention for the upper collar section of the sports shoe in a simplified schematic view.

FIG. 1 illustrates a sports shoe 1, by way of example, in particular a ski shoe. Said sports shoe 1 comprises a rigid and relatively inflexible outer shell 2, preferably made of plastic, which surrounds at least in sections a comparatively flexible or elastic inner shoe 3 inserted therein. The inner shoe 3 is preferably made of foamed plastic and textile materials to make it as comfortable as possible for the user when the foot of the user is inserted in the sports shoe 1, in particular in the inner shoe 3. The inner shoe 3 can be designed to be removed from the shell 2 or to be replaceable, but can also be permanently connected to the shell 3, in particular adhered or stitched.

The outer shell 2, preferably made by a plastic injection moulding process, can also have a plurality of openings and can thus form a frame or cage-like holding structure for the inner shoe 3. The outer shell 2 around the inner shoe 3 is used for transferring forces as efficiently as possible and with as few delays as possible between the foot of the user and the respective sports device onto which the sports shoe 1 is secured or arranged. Instead of the ski shoe illustrated by way of example the relevant sports shoe 1 can also be in form of a roller or ice-skate, a snowboard shoe or the like. In particular a generic sports shoe 1 is understood to mean any shoe that has a comparatively rigid outer shell 2 and at least one relatively rigid collar or shaft section and a comparatively flexible and elastic inner shoe 3 inserted therein.

The shell 2 preferably comprises a front foot shell 4 for supporting the front foot and a shoe collar 5 connected to the front foot shell 4, which surrounds or supports the lower section of the leg of a user, at least partly. The shoe collar 5 is preferably designed as an independent element and is connected by at least one hinge 6 to the front foot shell 4. This hinge connection can of course also comprise connecting means which permit a combined translatory and rotary coupling. Alternatively, it is also possible to design the shell 2 in one piece and to form a deformation zone in the shell 2 which is allocated to the twisting or bending area between the foot and the lower leg in order to enable bending between the front foot shell 4 and the shoe collar 5.

The hinge 6 or the transitional section between the front foot shell 4 and the shoe collar 5 defines a pivot axis which runs essentially at right angles to the longitudinal axis 7 of the shoe sole and essentially parallel to the standing plane 8 of the inner shoe 3. For the individual adjustment, limitation and/or damping of an adjusting movement between the front foot shell 4 and the shoe collar 5 an adjusting and/or damping device 9 can be formed on the sports shoe 1 according to the designs known from the prior art. By means of said adjusting and/or damping device 9 an angle of inclination 10 can be set between the front foot shell 4 and the shoe collar 5 or a defined individually adjustable resistance can be opposed by means of this adjusting and/or damping device 9 of a change in the angle of inclination 10 caused by the user bending between the shin and the front foot. In particular, by means of said adjusting and/or damping device 9 a so-called standard damping or standard limiting of the shoe collar 5 relative to the front foot shell 4 is performed. The adjusting and/or damping device 9 is preferably arranged in the rear section of the shoe collar 5 allocated to the calf.

The front foot shell 4 and/or the shoe collar 5 is allocated at least one lashing means 11 in order to change, in particular reduce and enlarge as necessary, the volume enclosed by the front foot shell 4 or by the shoe collar 5. In particular, by means of this at least one lashing means 11 a suitable pretensioning is exerted on the inner shoe 3 and the foot is supported in the sport shoe 1 with as little play as possible. Said lashing means 11 can be in the form of any known elements from the prior art, such as e.g. lever fasteners, ratchet elements, winding devices for tightening cords and the like. If necessary, adjustable pressure plate arrangements or the like can be used as lashing means 11 for securing or tightening the inner shoe 3 and supporting the foot. It is essential that by means of the at least one lashing means 11 an extremely reliable and as far as possible play-free support of the foot in the sports shoe 1 is achieved, when the at least one lashing means 11 is activated. In addition, the entry in and out of the sports shoe 1 should be as comfortable as possible when the at least one lashing means 11 is deactivated.

A sports shoe 1 designed as a ski shoe comprises on the shoe collar 5 at least one lashing means 11, preferably two lashing means 11, in the form of lever-activatable tightening fasteners in order to individually narrow or if necessary widen the opening width of the shoe collar 5.

The generic sports shoe 1, which comprises a relatively hard or rigid outer shell 2 and a comparatively flexible inner shoe 3, comprises in the upper end section of the shoe collar 5, in particular at the entry opening for the foot, a strap-like or ring-like tightening means 12. Said tightening means 12 is used for the individual tightening or limiting of the opening width, in particular for narrowing or limiting the width of the upper end section of the shoe collar 5. This upper end section of the shoe collar 5 surrounds in a known manner the entry opening into the sports shoe 1 and encloses the leg of the user in the calf region.

The tightening means 12, which are designed to be strap-like at least in part, are allocated at least one adjusting means 13, by means of which the effective length, i.e. the wrapping width or the pretensioning of the tightening means 12 can be adjusted or set relative to the shoe collar 5 according to the individual wishes of the user. Said adjusting means 13 can here be in the form of any elements known from the prior art for changing the length and/or the alignment and/or the tightening direction and/or the position of the tightening means 12. It is only essential that by way of this activatable adjusting means 13 the pretensioning of the tightening means 12 can be changed as desired on the inner shoe 3 or the shoe collar 5. By way of said adjusting means 13 either a relatively loose or play-free securing of the leg against the shoe collar 5 is permitted, whereby the tightening means 12 can be activated by the adjusting means 13, i.e. tightened and deactivated, i.e. loosened. Mainly, in order to permit the simple removal of the sports shoe 1 or the simple entry into the sports shoe 1 by activating the adjusting means 13 accordingly it is possible to loosen the tightening means 12. Said adjusting means 13 on the tightening means 12 or for the tightening means 12 can be in the form of a Velcro connection, a ratchet fastener, a tightening lever or other manually activatable and deactivatable coupling or tightening devices known from the prior art.

The inner shoe 3 projects in the generic sports shoe 1 at least in sections over an upper limiting edge 14 of the shoe collar 5. In particular, the upper end section of the soft or padded inner shoe 3 extends beyond the collar-like or cylindrical upper end section of the relatively rigid shoe collar 5 made of hard plastic. The upper end section, in particular the so-called neck of the inner shoe 3, similar to the sections of the inner shoe 3 mounted in the shell 2 has relatively thickly padded or foamed areas in order to ensure a comfortable and pressure point free fitting of the foot of a user. Mainly, by means of this relatively thick padding in the upper neck section of the inner shoe 3 uncomfortable pressure points on the lower leg, in particular on the shin or on the calf of the user, which often occur due to the upper limiting edge 14 of the shoe collar 5 or due to the relatively rigid, upper end section of the shoe collar 5, are avoided. To reduce such pressure points on the lower leg of the user the upper end section of the shoe collar 5—as already known—can also comprise slits, weakened areas, openings, roundings or sections made of comparatively elastic or flexible plastics or different materials. Likewise on the upper limiting edge 14 of the shoe collar 5 areas of thicker material, trumpet-like extensions or roundings or spoiler-like pressure distribution plates can be added, in order to prevent pressure points as far as possible in this transitional section between the shoe collar 5 and the inner shoe 3 on the foot or the shin of the user. However, these known measures on the shoe collar 5 or on the inner shoe 3 are only satisfactory to a limited degree and by these means the support of the foot or the lower leg in the sports shoe 1 is compromised. The aforementioned measures are mostly a compromise between a high degree of wearing comfort of the sports shoe 1 and good support for the foot and a perfect fit of the sports shoe 1. A play-free securing of the sports shoe 1 or the shoe collar 5 relative to the foot and the lower leg is however essential for the performance or well-being of the user during the use of the sports shoe 1 or the respective sports device. In particular, by supporting the foot in the sports shoe 1 with as little play and movement as possible the transfer of forces between the user and the sports device and vice versa can be achieved as directly and with as little damping as possible. The achievable performance and adequate wearing comfort are interconnected in sports shoes 1 to a certain extent.

It is essential that the partly strap-like tightening means 12 described in the following in detail prevents or at least reduces localized, uncomfortable or significant pressure points on the foot of the user in the transitional section between the shoe collar 5 and the inner shoe 3. In particular, by way of these improved tightening means 12 sudden lifts are prevented and there is a reduction in pressure points on the foot or the shin of the user in the upper end section of the sports shoe 1, i.e. in the region of the upper entry opening. In particular, the pressure loading in the lower leg of the user which acts on the transitional section between the shoe collar 5 and the inner shoe 3 is harmonized as far as possible or smoothed out more effectively.

The upper tightening means 12 for the shoe collar 5 extends, as shown by way of example in FIG. 1, preferably in a ring at least around sections of the periphery of the upper end section of the sports shoe 1. With respect to the longitudinal extension of the tightening means 12 inside a section of this tightening means 12 a first and at least one further tightening element 15, 16 are arranged adjacent to one another and parallel to one another. In particular, a first tightening element 15 and at least one further tightening element 16 are arranged perpendicular to the tightening direction or longitudinal extension of the tightening means 12. Said tightening elements 15, 16 run essentially parallel to one another and the tightening elements 15, 16 act in parallel, as can be taken from the view shown FIG. 1 by way of example. The tightening elements 15, 16 extending at least over part of the length of the tightening means 12 are designed here preferably to be strap-like and their flat or broad sides are provided for pressure loading on the inner shoe 3 and the shoe collar 5. It is essential that the first or upper tightening element 15 is designed for bearing directly on the peripheral sections of the inner shoe 3, i.e. for the direct pressure loading of the relatively flexible or soft inner shoe 3 and/or its tongue 17, and the further tightening element 16 arranged underneath is designed for bearing on the upper end section of the shoe collar 5 or for pressure loading the upper end section of the shoe collar 5. The shoe collar 5 is made of a relatively rigid and comparatively inflexible plastic, in particular a thermoplastic material.

Preferably, the first or the upper tightening element 15 is provided for applying a desired or appropriate tightening or pretensioning onto a tongue 17 or a section of the inner shoe 3 closest to the tongue 17. In contrast the further or lower tightening element 16 is designed for applying a suitable tightening of pretensioning on the shoe collar 5, in particular on the outer surfaces of the shoe collar 5. Preferably, the upper tightening element 15 is provided for exclusively pressure loading an outer part of the inner shoe 3, in particular the tongue section of the inner shoe 3. In addition, the first or upper tightening element 15 can also bear against the outer sections of the shoe collar 5. This means that the first or upper tightening element 15 extends primarily over the outer surfaces of the inner shoe 3 or its tongue 17, whereas the other tightening element 16 arranged underneath is mainly allocated to the shoe collar 5 and is designed for pressurising the outer sections of the shoe collar 5.

A similar pressure loading at least of sections of the neck or end section of the inner shoe 3 projecting beyond the shoe collar 5 by means of the first tightening element 15 and a parallel and simultaneous pressure loading of the upper end section of the shoe collar 5 by means of the further, parallel tightening element 16 is performed in particular when the multiple-part or at least partly double-stranded tightening means 12 is activated by the user. For this the user of the sports shoe 1 tightens the tightening means 12 via the adjusting means 13 and fixes the desired pretensioning of the tightening means 12 by way of the adjusting means 13. Preferably, the pretensioning is established and fixed by a single adjusting means 13. If necessary however, a separate fixing means can be provided. The adjusting means 13 can in this case act simultaneously on both tightening elements 15, 16.

According to an advantageous embodiment it is also possible for each tightening element 15, 16 to be allocated a separate adjusting means 18, 19 for the individual adjustment or change in its effective length or pretensioning, It is possible in particular to provide an adjusting means 18, 19 for influencing the two tightening elements 15, 16 independently and if necessary to form a third adjusting means 13 for the joint alteration or influence of the two tightening elements 15, 16. It is also possible to design an adjusting means 18 or 19 for the upper or the lower tightening element 15 or 16 and to provide an additional adjusting means 13, by means of which the length of the tightening means 12 or the tightening force of the upper and lower tightening element 15, 16 can be changed or adjusted together as desired.

With at least one end section, preferably both end sections of the two parallel tightening elements 15, 16, at least one strap or cord-like connecting element 20 is connected, by means of which the two tightening elements 15, 16 are joined together to form a common tightening strand and are positioned against the shoe collar 5 or mounted or anchored on the sports shoe 1. The two essentially parallel acting tightening elements 15, 16 thus run over only a section of the length of the tightening means 12 and pass at least into one of the two end sections into a joining or coupling connecting element 20. This means that the tightening means 12 with respect to the two tightening elements 15, 16 and the adjoining connecting element 20 forms essentially Y- or star-shaped tightening strands. The transitions between the double-stranded, front section with the tightening elements 15, 16 on the single strand section with the connecting element 20 are preferably allocated to the outside (according to the view in FIG. 1) and the opposite inside of the sports shoe 1.

Preferably, a flat or plate-like coupling element 21 is formed which connects the two tightening elements 15, 16 with the adjoining connecting element 20. Of course, it is also possible to design the connecting element 20 and the adjoining, parallel acting tightening elements 15, 16 in one piece, in that a strap-like element is slit at least in sections along its longitudinal direction, in order to form two strap-like, essentially independent or separate tightening elements 15, 16. Alternatively, it is also possible to design the connecting element 20 in one piece or to be continuous with one of the two tightening elements 15 or 16 and to connect or laterally join the additional tightening element 16 or 15 extending parallel over a part section by at least one coupling element 21 to the continuously extending tightening stand. This means that the tightening means 12 with its three tightening strands can be formed by a one piece tightening element or can be composed of two or three strap-like tightening elements.

It is essential that the double or multiple strand section of the tightening means 12 is allocated to the sports shoe 1 such that its first or upper tightening element 15 can act directly on the outer surfaces of the inner shoe 3 and the further or underlying tightening element 16 can act on the outer surfaces in the upper end section of the shoe collar 5, and thus also acts indirectly or with the interconnection of the shoe collar 5 on the inner shoe 3. In this way, the multiple-stranded or at least double-stranded section of the strap-like tightening means 12 facilitates the support of the sports shoe 1 on the foot or leg of the user. A tightening means 12 of this kind is however also advantageous in respect of providing a harmonious distribution of force against the foot of the user in the transitional section between the shoe collar 5 and the section of the inner shoe 3 projecting over the shoe collar 5. This is mainly when the double, tightening strands of the tightening means 12 coupled at an end section are assigned to the front collar section or the tongue section of the inner shoe 3, as shown in FIG. 1 and also in the detailed view of FIG. 2. In particular, within a partial section of the length of the tightening means 12 a first tightening element 15 and a further tightening element 16 are arranged above one another in vertical direction to the standing plane 24 of the sports shoe 1, whereby said tightening elements 15, 16 run essentially parallel to one another.

Figure 2:
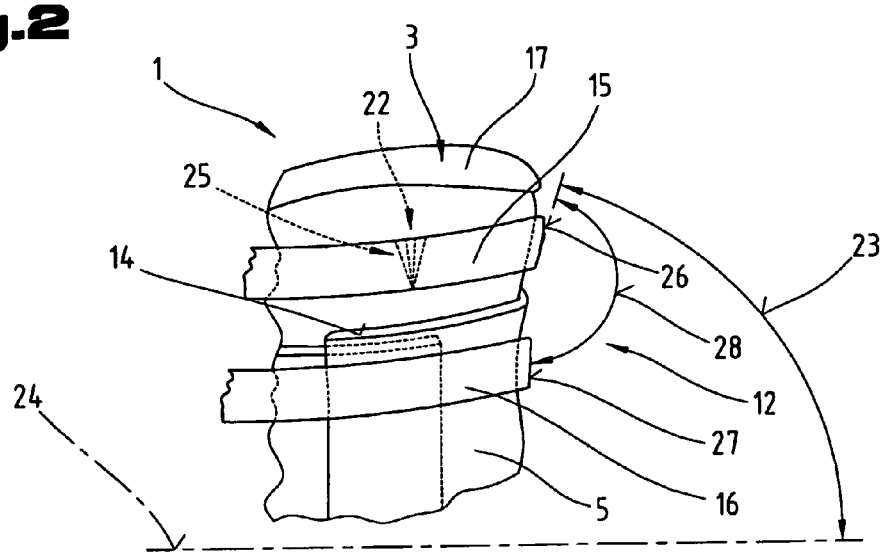
FIG. 2 shows a partial section of a shoe collar of a generic sports shoe with sections of the tightening means in a simplified, exemplary view.

As best shown in FIG. 2, the first or upper tightening element 15 can be designed so that its alignment relative to the further or lower tightening element 16 can be varied, in particular changed in inclination, or can be arranged at a specific angle of inclination relative to the lower tightening element 16. In particular, the first tightening element 15 can comprise at least one folding or gusset section 22, by means of which the alignment or angle of inclination 23 of the strap-like tightening element 15 is made relative to the horizontal standing plane 24 of the sports shoe 1 or can be changed with tightening or torsion loading during the use of the sports shoe 1. This folding or gusset section 22 on or in the first tightening element 15 is a kind of adjusting element 25 for presetting, changing or adapting the tightening element 15 to the respective inclination or shaping of the inner shoe 3. This applies mainly when forces are directed via the shin of the user into the sports shoe 1. The adjusting element 25, in particular the folding or gusset section 22, is used mainly when the inner shoe 3 during the use of the sports shoe 1 is exposed in its upper end or neck section against the shoe collar 5 to corresponding bending or deformation forces.

Figure 3:
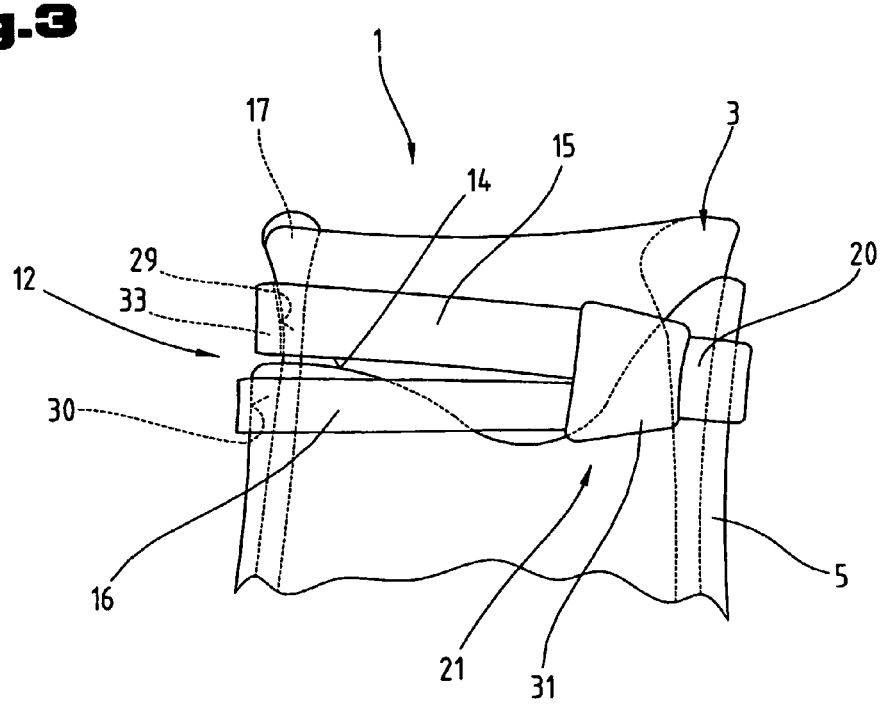
FIG. 3 shows a further sports shoe with the tightening means in its neck section.

In the lateral view of the sports shoe 1—according to FIG. 1—or with reference to a cross sectional view of the upper and lower tightening element 15, 16, the upper and lower tightening element 15, 16 preferably comprise in a position of use or stress of the tightening means 12 angularly aligned outer surfaces 26, 27, as illustrated schematically in FIG. 2. In particular, the angle 28 between the outer surfaces 26, 27 of the upper and lower tightening element 15, 16 in the tightened position of the tightening means 12 is about 140° to 175°. By means of this possible adjustment or angular alignment between the tightening elements 15, 16 there can be a full surface transfer of pressure between the inside of the upper tightening element 15 and the outer surface of the inner shoe 3 or its tongue 17. In an advantageous manner in this way local or linear pressure points are avoided between the upper tightening element 15 and the inner shoe 3 or the shin of the user located therein. In particular, the adjusting element 25 in the form of a folding or gusset section 22 in the tightening element 15 ensures a transfer of force or pressure between the strap-like tightening element 15 and the outside of the inner shoe 3 over as full a surface as possible. In addition, the upper tightening element 15 with changing loads can adapt better to the various deformations or bending movements of the inner shoe 3 or its tongue in the section above the comparatively rigid shoe collar 5. Alternatively or in combination with this it is also possible to design the first tightening element 15 allocated to the inner shoe 3 or its tongue 17 to be wedge-shaped in cross section, as indicated in FIG. 3.

An upper tightening element 15 of this kind that is designed to be wedge shape at least in sections also provides a secure positioning or reliable maintenance of the desired, correct position of the whole tightening means 12 in relation to the shoe collar 5. In particular, at least to the upper tightening element 15 increased resistance to deviating movements in upwards direction are counteracted. By means of a wedge or displacement effect of the tightening means 12 resulting from the occurrence of extension or widening forces, which can be obtained either by inclined inner surfaces of the tightening elements 15, 16 or by the previously described folding or gusset section 22—FIG. 2, the desired position or pretensioning of the tightening means 12 can be kept constant even after a long period of use and with changing stresses. In particular, the user of the sports shoe 1 provided with a with changing stresses. In particular, the user of the sports shoe 1 provided with a tightening means 12 of this kind for the upper neck section is ensured a long term constant tightening behaviour and a largely consistent shoe fitting. To stabilize the desired position or tightening of the tightening means 12 it is advantageous if the first or upper tightening element 15 and the further or lower tightening element 16 in the position of use or loading of the tightening means 12 form bearing surfaces 29, 30 that are at an angle to one another relative to the inner shoe 3 or the shoe collar 5, as shown by way of example in FIG. 3.

In order to reliably maintain the desired position or alignment of the tightening means 12 or its prestressing, alternatively or in combination with the previously described embodiments, it is also possible that at least one of the two parallel connected tightening elements 15, 16 is designed to be elastically extensible. Preferably, the first tightening element 15 provided for bearing on the tongue 17 or on the tongue section of the inner shoe 3 is designed to be relatively resistant to extension and the parallel acting tightening element 16 designed primarily for loading the shoe collar 5 is designed to be elastically extensible relative to the first tightening element 15. According to a different embodiment however the first tightening element 15 can also have a certain amount of material elasticity or can be elastically extensible.

Figure 4:
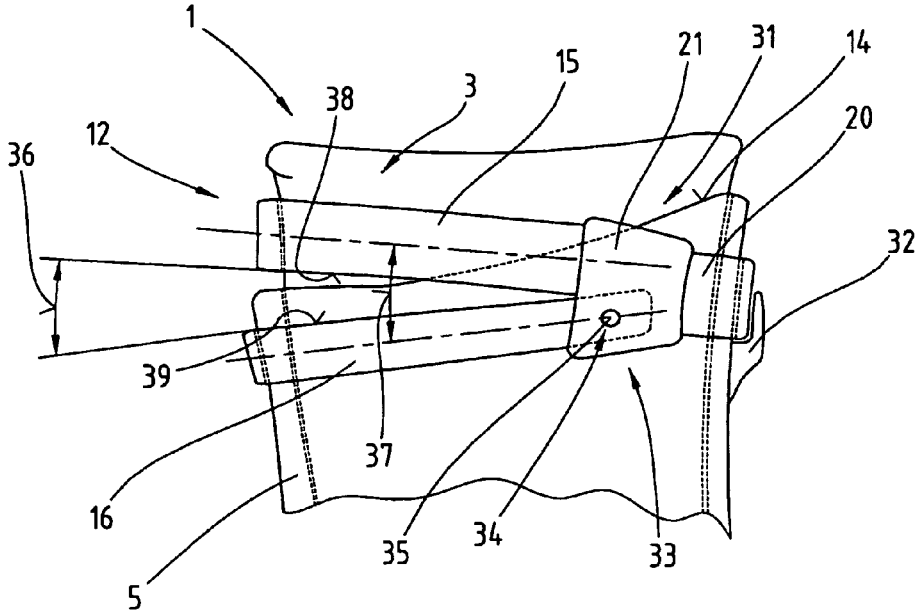
FIG. 4 shows a further embodiment of the tightening means in the upper end section of a sports shoe.

FIG. 4 shows a further embodiment of the tightening means 12 for the upper neck section of a generic sports shoe 1. It can be seen from this that the tightening means 12 comprises at least one force distribution section 31 in which the two tightening elements 15, 16 merge together or are joined by the coupling element 21, so that the two tightening elements 15, 16 are coupled at least one of their closest end sections. The joint, preferably strap-like connecting element 20 is connected to this at least one coupling element 21 or the force distribution section 31 passes into a connecting element 20. The connecting element 20 leads in a strap or band-like manner in the direction of the rear side of the shoe collar 5. Said connecting element 20 can be connected securely with the shoe collar 5 in the rear section of the shoe collar 5, for example screwed or riveted. As shown schematically, the strap-like connecting element 20 can also be secured in the rear of lateral section of the shoe collar 5 by means of at least one holding extension 32 or by means of threading through an opening in the shoe collar 5 or the like. This securing is mainly used so that the tightening means 12 is secured in position on the sports shoe 1 in the loosened or opened state so that it cannot get lost.

In the force distribution section 31, in particular on the coupling element 21 for the two tightening elements 15, 16, at least one fitting means 33 can be designed for adjusting or changing the tightening direction of at least one of the tightening elements 15, 16. Said fitting means 33 can be in the form of a hinge connection 34 for example in the force distribution section 31 or on the coupling element 21 in relation to at least one tightening element 15, 16. In the embodiment shown the lower tightening element 16 can be hinge connected via at least one hinge connection 34 to the force distribution section 31. A pivot axis 35 of this hinge connection 34 here runs essentially at right angles to the flat sides of the tightening elements 15 or 16. Instead of a mechanical hinge connection 34, which can be in the form of rivet connection for example, it is also possible to form the hinge connection 34 by having elastic deformation zones in the transitional section between the tightening element 15 or 16 and the force distribution section 31. For example elastic bands or the previously described folding or gusset sections 22 can be used for this—FIG. 2.

Preferably, at each of the distal ends of the tightening elements 15, 16 a force distribution section 31 or a coupling element 21 is formed. These two force distribution sections 31 or coupling elements 21 are preferably allocated to the lateral sections of the sports shoes 1, in particular the inner and outer side wall of the shoe collar 5.

By means of the at least one fitting means 33 for the alignment or tightening of the tightening elements 15, 16 a spreading angle 36 between the tightening elements 15, 16 can also be changed or adjusted individually. By means of a user activated or force-defined change in the spreading angle 36 between the tightening elements 15, 16 the distance 37 also changes between the adjacent longitudinal edges 38, 39 of the tightening elements 15, 16.

Figure 5:
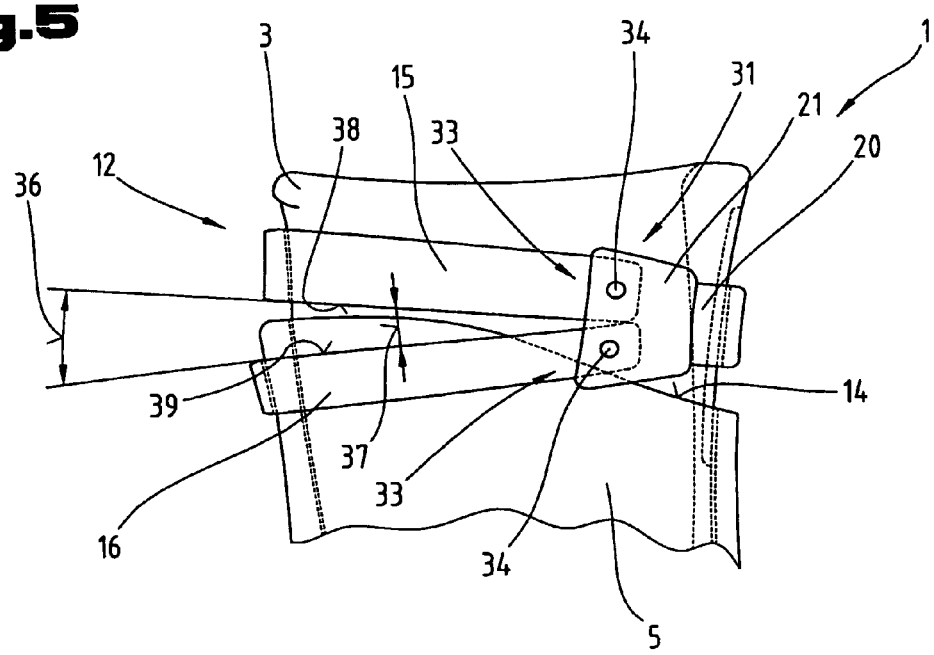
FIG. 5 shows a further embodiment of the tightening means for the upper collar section of a sports shoe.

In the embodiment according to FIG. 5 in the force distribution section 31 of the tightening means 12, in particular at its coupling element 21, for each of the tightening elements 15, 16 adjusting means 33 are provided, in particular hinge connections 34, for changing the spreading angle 36 or distance 37 between the tightening elements 15, 16. In this way the tightening direction of each tightening element 15, 16 can be adjusted individually to the alignment or tightening direction of the common connecting element 20 or adjusted to the given circumstances.

The tightening means 12 comprises at least one star or Y-shaped force distribution section 31, in which the tightening direction of the individual tightening strands can be predefined or predetermined or—according to the design in FIG. 5—can be adjusted to individual requirements or various conditions. Furthermore, by means of these fitting means 33 an exact allocation of the tightening element 16 to the primary loading of the shoe collar 5 and of the tightening element 15 to the primary loading of the front section of the inner shoe 3 can be achieved. In particular, the tightening element 15 can be allocated exactly or as desired to the inner shoe 3, in order to exert a suitable level of tightening on the latter. Mainly with shoe necks with a widely varying upper limiting edge 14 of the shoe collar 5 this kind of flexibility of the adjustment of the tightening direction or alignment of at least one of the tightening elements 15, 16 can be advantageous.

Alternatively or in combination with this it is also possible to make the position and/or alignment of the joint connecting element 20 for the tightening elements 15, 16 adjustable in vertical direction relative to the shoe collar 5.

The connecting element 20 comprises at least one anchoring or connecting point on the sports shoe 1. This is preferably arranged on the rear of the shoe collar 5, as shown in the designs in FIG. 3 or 4. Alternatively, this retaining point for the tightening means 12 can also be formed on the rear section of the inner shoe 3, as illustrated by way of example in FIG. 5. In particular, the introduction of force or force transfer of the connecting element 20 in the direction of the rear section of the inner shoe is achieved in this way. If necessary, in the rear section of the inner shoe 3 a plate-like reinforcement can be included or between the inner shoe 3 and the shoe collar 5 a plate-like intermediate element can be inserted, on which the connecting element 20 bears or is secured. Said intermediate element is used for the distribution of pressure from the stresses acting via the connecting element 20 on the rear section of the inner shoe 3.

Figure 6:
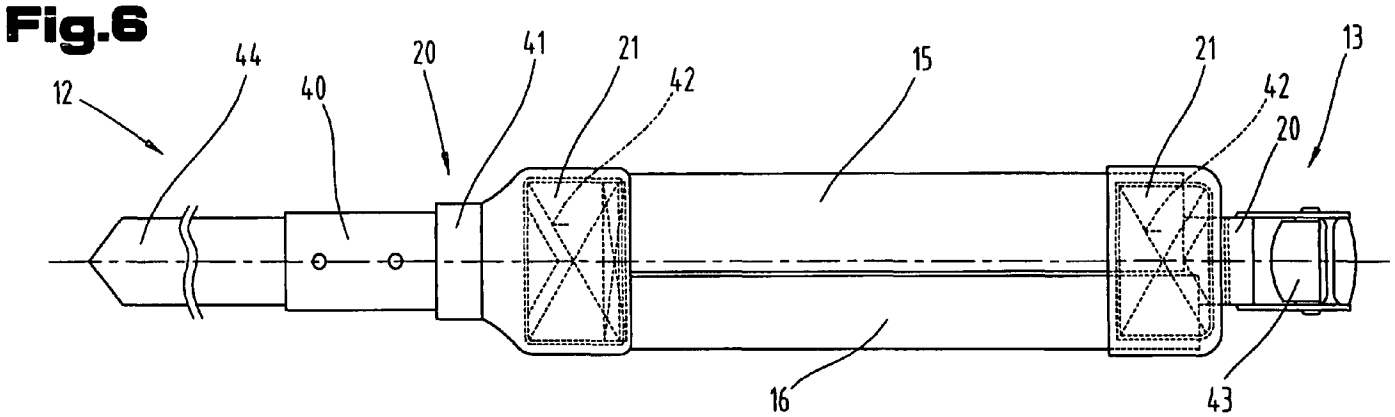
FIG. 6 shows an exemplary embodiment of the tightening means in plan view.

FIG. 6 shows a possible embodiment of the tightening means 12. The two essentially parallel strap-like tightening elements 15, 16 merge respectively at their distal ends into a coupling element 21. At least one of the two coupling elements 21 extends up to a retaining means 40 for securing the tightening means 12 onto a sports shoe. The retaining means 40 and the coupling element 21 can in this case be designed in one piece and a separate connecting element 41 can be formed between the retaining means 40 and the coupling element 21, which connects the retaining means 40 and the coupling element 21 tightly together. The retaining means 40 is used in this case for securing the tightening means 12 in the region of the rear of the shoe collar in a variable position or in a fixed position. In this case for example screw and/or form-closed connections can be provided between the retaining means 40 and the shoe collar. The retaining means 40 is preferably designed to be in the form of a plate.

The coupling elements 21 are connected together by seams 42 in the embodiment shown. The coupling elements 21 are preferably made of plastic or leather, whereas the tightening elements 15, 16 are preferably made of a textile material preferably provided with high tensile elements or alternatively with rubber fibres to form a tightening element 15, 16 in the form of a rubber band.

The first tightening element 15 allocated to the inner shoe is preferably designed to be wider than the other tightening element 16 allocated to the shoe collar, as shown in FIG. 6. In this way the pressure distribution is improved in relation to the comparatively more flexible, elastic inner shoe 3, and a relatively large bearing or support surface is created between the tightening element 15 and the inner shoe or its tongue.

The adjusting means 13 for the individual adjustment of the wrapping width or tightening of the tightening means 12 is formed in the embodiment shown by a lever fastener 43. By means of a lever fastener 43 known from the prior art a relatively high tightening or tensile force can be achieved and the tightening means 12 can be held reliably in the tightened position and if necessary can be loosened in a simple manner Said lever fastener 43 is connected tightly with one of the two coupling elements 21. By means of a lashing extension 44 which is connected with the additional coupling element 21 or with the retaining means 40, the diameter or wrapping width of the tightening means 12 can be adjusted individually. In this case, the lashing extension 44 which can be formed by a toothed belt, is secured, in particular clamped or locked, in the desired overlapping width to the other end of the tightening means 12. Any adjusting means 13 known from the prior art can be used as the lever fastener 43 and lashing extension 44. It is particularly advantageous to use a so-called pump or ratchet fastener as a lever fastener 43, in which a lashing extension 44 can be inserted in the form of a toothed belt, in order to thus regulate the width or the mechanical tightening of the tightening means 12.

The lever fastener 43 is provided in particular to connect the distal ends of the tightening means 12 at the desired effective length.

The tightening means 12 runs in the active position of use preferably in a ring around the shoe collar 5 and the inner shoe 3, as illustrated in FIG. 1. The wrapping angle of the tightening means 12 can here be between 180° and 360°. This means that the tightening means 12 can also run over part sections of the periphery of the shoe collar 5. Furthermore, the tightening means 12 can be designed to have at least two parts, as is shown for example in the view according to FIG. 7. In this case the tightening means 12 is designed to be in two parts in respect of its retaining means 40. In particular, two retaining parts are formed which together produce the retaining means 40 for the multiple part tightening means 12. The two retaining parts are here preferably screwed or riveted onto the shoe collar 5—FIG. 1, or secured in a form-closed manner onto the shoe collar. The retaining parts or the retaining means 40 formed therefrom represent the anchoring point for the tightening means 12. The tightening element of the tightening means 12 shown at the bottom of FIG. 7 corresponds essentially to the design shown in FIG. 6. The tightening element of the tightening means 12 shown above in turn comprises a lashing extension 44 as a counterpiece to the adjusting means 13 or as a coupling element for the lever fastener 43. A cord-like connecting element 41 is formed between the lashing extension 44 and the retaining means 40 for anchoring onto the shoe collar in the embodiment shown. Preferably, said cord-like connecting element 41 runs in a double strand or in a loop between the lashing extension 44 and the retaining means 44.

Also the connecting means 41 between the coupling element 21 for the tightening elements 15, 16 and the other retaining means 40 for securing the tightening means 12 to the sports shoe can be in the form of a cord. Preferably, this can be a looped or double stranded cord.

In the unloaded or extended position of the tightening means 12 the first tightening element 15 and the other tightening element 16 are arranged essentially in a common plane 45 adjacent to one another. This arrangement is such that adjacent longitudinal edges 38, 39 of the first and further tightening element 15, 16 are spaced apart at a distance 46 of 0.5 to 10 mm, preferably about 2 mm.

Figure 7:
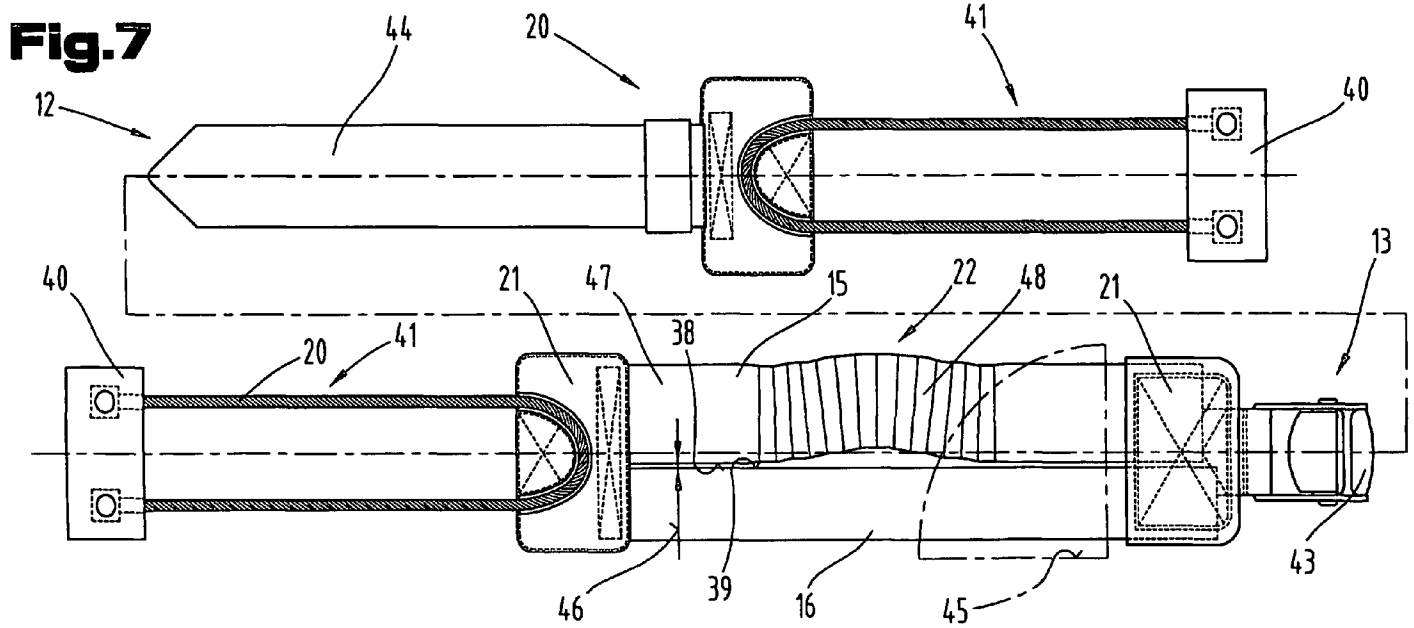
FIG. 7 shows a further embodiment of the tightening means for the upper neck section of a sports shoe.

According to the design in FIG. 7 the lower tightening element 16 assigned to the shoe collar can be shorter than the upper tightening element 15 allocated to the inner shoe. In particular, the lower tightening element 16 assigned to the shoe collar in the unloaded or relaxed position can have an absolute length that is about 5 mm shorter than the upper tightening element 15 allocated to the inner shoe. Preferably, in this case the lower tightening element 16 is designed to be elastically extensible. The upper tightening element 15 allocated to the inner shoe is preferably designed as a limiting means 47 for a maximum possible longitudinal extension of the lower elastically extensible tightening element 16 allocated to the shoe collar. Overstressing the elastically extensible, lower tightening element 16 to pressurize the shoe collar can thus be avoided in a simple manner.

In the unloaded or relaxed state, in which the lower tightening element 16 is stretched flat, at least one fold 48, loop or wave is formed in the upper tightening element 15, which is the limiting means 47 with respect to a maximum possible longitudinal extension of the tightening means 12, as illustrated schematically in FIG. 7.

Figure 8:
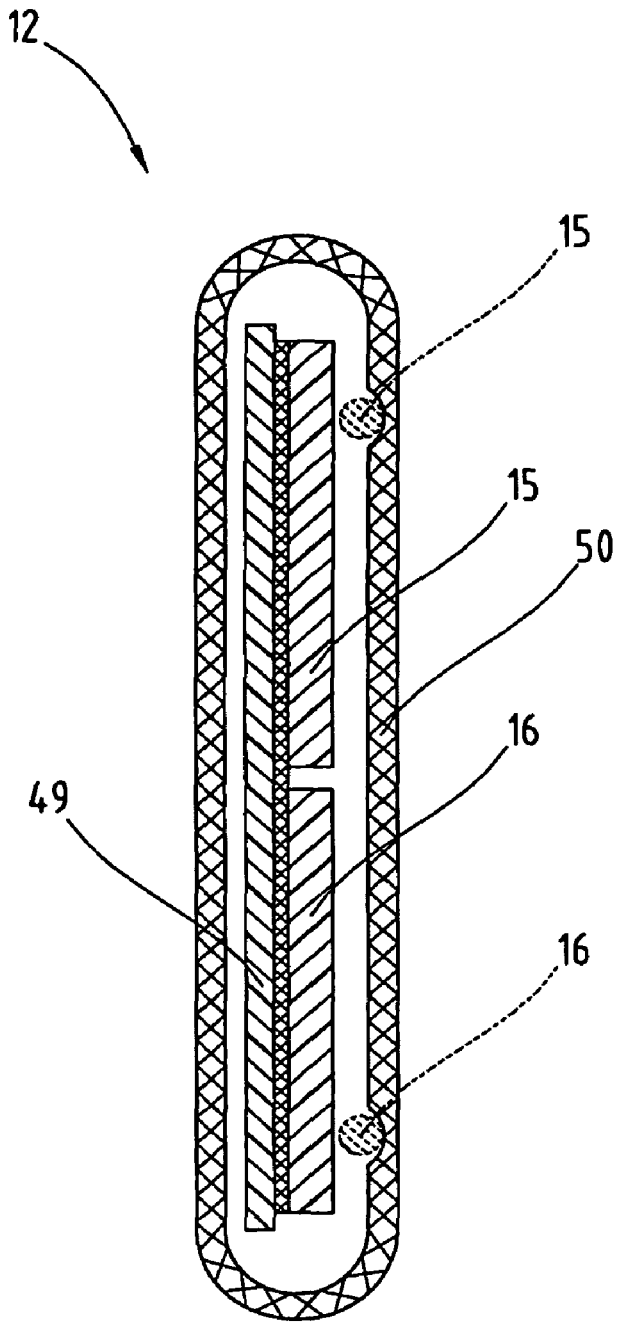
FIG. 8 shows a cross section of a further embodiment of the tightening means in a simplified, schematic view.

FIG. 8 shows schematically a cross section of a possible embodiment of the tightening means 12 in a partial section with the two parallel tightening elements 15, 16. The two adjacent, essentially parallel, preferably strap-like tightening elements 15, 16 can, as shown by dashed lines, be formed alternatively in combination therewith by cord-like tightening elements 15, 16. If cord-like tightening elements 15, 16 are used instead of or in combination with strap-like tightening elements 15, 16, the former preferably also run essentially parallel to one another. Effectively, the lower, cord-like tightening element 16 is assigned to the shoe collar and the upper tightening element 15 is allocated to the front or side sections of the inner shoe.

If necessary, to reinforce the tightening effect or increase the maximum tightening load strap and cord-like tightening elements 15, 16 can be used together. The tightening elements 15, 16 are designed so that they can withstand the mechanical prestressing applied to the neck section of the sports shoe.

According to an optional development it is also possible to couple the two tightening elements 15, 16 by using at least one elastic transverse connection 49, as shown by way of example and schematically in FIG. 8. In particular, the elastically flexible and self-restoring cross connection 49 connects the two tightening elements 15, 16 at right angles to their tightening or longitudinal direction. The transverse connection 49 formed from an elastic material can thus be stitched or adhered to the two tightening elements 15, 16 or can be connected to the two tightening elements 15, 16 in a different way. The elastically flexible transverse connection 49 here permits elastically restoring shearing movements between the tightening elements 15, 16 or in this way a relative displacement between the tightening elements 15, 16 in transverse direction to their flat sides is counteracted by an elastically flexible resistance. The elastic transverse connection 49 also prevents widely varying pretensioning stresses or tensile stresses between the first tightening element 15 and the other tightening element 16. In particular, by means of this at least one transverse connection 49 a equalisation of tightening is established between the two tightening elements 15, 16. Furthermore, by means of such a transverse connection 49 with limited, elastic flexibility the alignment or allocation of the tightening elements 15, 16 can be better maintained relative to one another and relative to the sports shoe, in particular to the inner shoe or relative to the shoe collar.

According to a further embodiment the tightening means 12 can also be provided with a covering 50 over at least parts of the tightening elements 15, 16 or with a casing enclosing the tightening elements 15, 16 in a tube-like manner. Said covering 50 or casing for the tightening elements 15, 16 is preferably made of a textile or textile-like material, whereas the tightening elements 15, 16 mounted therein or underneath are made of a highly-resistant and high strength plastic material, for example PVC or the like. The covering 50 formed at least in sections or the at least partial casing of the tightening elements 15, 16 can also be used on the outside to mount a design or a label.

The covering 50 or the casing is here either not connected or only connected at certain points or in sections to the tightening elements 15, 16, so that relative displacement is not prevented between the tightening elements 15, 16 or is only slightly prevented. A tubular covering 50 designed as a casing is preferably relatively adjustable and optionally replaceable by the user in the longitudinal direction of the tightening elements 15, 16 and in particular can be pushed on and removed from the two tightening elements 15, 16.

The exemplary embodiments show possible variations of the sports shoe 1 or its tightening means 12, whereby at this point it should be noted that the invention is not restricted to the particular embodiments illustrated in particular, but rather various combinations of the individual embodiments are possible and this variability lies within the ability of a person skilled in this technical field on the basis of the teaching of the present invention. Also all conceivable variations of the design which are possible by combining individual details of the embodiments shown and described are also covered by the scope of protection.

For form's sake it should be noted that for a better understanding of the structure of the sports shoe 1 or the tightening means 12 the latter and its components are not always illustrated to scale and have been enlarged and/or reduced in size.

Mainly the individual embodiments shown in FIGS. 1; 2; 3; 4; 5; 6; 7; 8 can form the subject matter of independent solutions according to the invention. The objectives and solutions according to the invention can be taken from the detailed descriptions of the Figures.

LIST OF REFERENCE NUMBERS

1 Sports shoe
2 Shell
3 Inner shoe
4 Front shoe shell
5 Shoe collar
6 Hinge
7 Longitudinal axis
8 Standing plane
9 Adjusting and/or damping device
10 Angle of inclination
11 Lashing means
12 Tightening means
13 Adjusting means
14 Limiting edge
15 Tightening element
16 Tightening element
17 Tongue
18 Adjusting means
19 Adjusting means
20 Connecting element
21 Coupling element
22 Fold or gusset element
23 Angle of inclination

24 Standing plane
25 Adjusting element
26 Outer surface
27 Outer surface
28 Angle
29 Bearing surface
30 Bearing surface
31 Force distribution section
32 Retaining projection
33 Fitting means
34 Hinge connection
35 Pivot axis
36 Expansion angle
37 Distance
38 Longitudinal edge
39 Longitudinal edge
40 Retaining means
41 Connecting element
42 Seam
43 Lever fastener
44 Lashing extension
45 Plane
46 Distance
47 Limiting means
48 Fold
49 Transverse connection
50 Covering

What is claimed is:

1. Sports shoe with an outer shell made of injection molded plastic, comprising a front foot shell for supporting the front of the foot and a shoe collar connected thereto for stabilizing the lower section of the leg of a user and with a comparatively flexible inner shoe mounted at least partly in the shell, whereby the inner shoe extends at least in sections over the upper end of the shoe collar, in particular a ski shoe with at least one tightener arranged in the upper end section of the shoe collar running ring-like around the upper end section of the shoe collar, said tightener comprising at least one adjuster for tightening or limiting the width of the entry opening into the sports shoe as desired, and said tightener further comprising a first coupling element connected to said adjuster, a first tightening element extending between said first coupling element and a second coupling element, and a lashing extension connected to said second coupling element, where said first tightening element forms a section of the length of said tightener, and said adjuster, said first coupling element, said first tightening element, said second coupling element, and said lashing extension are arranged in a row and connectable at their ends in a chain-like manner, and where the distal ends of the tightener are connectable to each other so that the tightener is closed in a ring-like manner in its position of use, wherein said section of the length of the tightener is formed by said first tightening element and a second tightening element, said first tightening element and second tightening element are arranged above one another in vertical direction and are essentially parallel to one another, whereby the first tightening element is designed for bearing on the peripheral sections of the comparatively flexible inner shoe or its tongue and the second tightening element is designed to bear against the upper end section of the shoe collar made of a relatively rigid plastic, and wherein with the end sections of each of said first and second tightening elements one of said first and second coupling elements are connected, via which said tightening elements are joined together to form a common tightening strand.

2. Sports shoe according to claim 1, wherein the first tightening element is arranged to apply tensile stress or pretensioning on a tongue or on a section of the inner shoe closest to the tongue, and the second tightening element is designed to apply tensile stress or pretensioning on the outside of the shoe collar.

3. Sports shoe according to claim 1, wherein at least one additional adjuster is provided for the individual adjustment of the tensile stress or pretensioning, in particular of the effective length of the first tightening element and/or the additional tightening element.

4. Sports shoe according to claim 1, wherein one of the two parallel connected tightening elements is designed to be elastically extensible.

5. Sports shoe according to claim 1, wherein the first tightening element provided for bearing on the tongue or on the tongue section of the inner shoe is designed to be relatively resistant to stretching in respect of the stresses arising during use, and the parallel tightening element designed to bear on the shoe collar is designed to be elastically extensible compared to the first tightening element.

6. Sports shoe according to claim 1, wherein the first tightening element and the second tightening element are designed to be strap-like, and in the unstressed position are arranged with their flat sides essentially in a common plane.

7. Sports shoe according to claim 1, wherein adjacent longitudinal edges of the first and second tightening elements are spaced apart at a distance of 0.5 to 10 mm.

8. Sports shoe according to claim 1, wherein the first or upper tightening element comprises an inherent adjusting section or an adjusting element, for example a folding or gusset section, to provide a predefined adjustment or force-defined adaptation of the angle relative to the other or lower tightening element.

9. Sports shoe according to claim 1, wherein the first or upper and the second or lower tightening element at least in the position of use or stress of the tightener form bearing surfaces that are aligned at an angle relative to one another, relative to the inner shoe and relative to the shoe collar.

10. Sports shoe according to claim 1, wherein an angle formed between outer surfaces of the first and second tightening element in the actively tightened position of the tightener is about 140° to 175° .

11. Sports shoe according to claim 1, wherein the first tightening element assigned to the inner shoe is designed to be wedge-shaped in cross section.

12. Sports shoe according to claim 1, wherein the tightening element allocated to the shoe collar is shorter than the first tightening element allocated to the inner shoe.

13. Sports shoe according to claim 12, wherein the tightening element allocated to the shoe collar in the unloaded or relaxed position has an absolute length that is about 5 mm shorter than the tightening element assigned to the inner shoe.

14. Sports shoe according to claim 1, wherein the first tightening element allocated to the inner shoe is designed as a limiter for a maximum possible longitudinal extension of the other tightening element allocated to the shoe collar.

15. Sports shoe according to claim 1, wherein one of said coupling elements functions as a force distribution section for a star or Y-shaped distribution of its tightening or pressure forces.

16. Sports shoe according to claim 15, wherein one of said coupling elements couples the essentially parallel tightening elements at their adjacent end sections and connects the tightener with a retainer on the shoe collar.

17. Sports shoe according to claim 16, wherein between the retainer and the coupling element at least one strap or cable-like connecting element is formed.

18. Sports shoe according to claim 16, wherein the retainer is designed to be plate-like and to be secured to the rear of the shoe collar.

19. Sports shoe according to claim 16, wherein the coupling element and the essentially parallel tightening elements are connected together by seams.

20. Sports shoe according to claim 1, wherein the tightening element allocated to the inner shoe is designed to be wider than the tightening element allocated to the shoe collar.

21. Sports shoe according to claim 1, wherein the first and second tightening element are formed by a band-like strip, preferably made of plastic, and are surrounded at least partly by a covering or casing made from a textile material.

22. Sports shoe according to claim 1, wherein the first and second tightening element are connected together by at least one elastic transverse connection at right angles to the tightening direction of the tightener.

23. Sports shoe according to claim 1, wherein the first tightening element allocated to the inner shoe or its tongue is designed to be elastically extensible with respect to the stresses occurring during use and the second tightening element allocated to the shoe collar is designed to be comparatively resistance to extension.

24. Sports shoe according to claim 1, wherein the adjuster is formed by a lever fastener which connects the distal ends of the tightener in a non-displaceable manner at the desired length or wrapping width.

25. Sports shoe according to claim 1, wherein the tightener in the active position of use is closed in a ring-like manner or like a tightening ring around the shoe collar and around sections of the inner shoe lying outside the shoe collar.

26. Tightener for the above collar section of a sports shoe, wherein it is designed for use in combination with a sports shoe according to claim 1.

* * * * *